US012448099B2

(12) United States Patent
Abiven et al.

(10) Patent No.: US 12,448,099 B2
(45) Date of Patent: Oct. 21, 2025

(54) SAILING VESSEL PROVIDED WITH A TRANSIT PART FOR LOWERING AND HOISTING SAID SAIL

(71) Applicant: CHANTIERS DE L'ATLANTIQUE, Saint Nazaire (FR)

(72) Inventors: Nicolas Abiven, La Baule (FR); Emeric Lacroix, Pornichet (FR); Maël Resche, Saint Nazaire (FR); Théo Desgranges, Brevin Les Pins (FR)

(73) Assignee: CHANTIERS DE L'ATLANTIQUE (FR)

( * ) Notice: Subject to any disclaimer, the term of this patent is extended or adjusted under 35 U.S.C. 154(b) by 550 days.

(21) Appl. No.: 17/982,823

(22) Filed: Nov. 8, 2022

(65) Prior Publication Data

US 2023/0148021 A1 May 11, 2023

(30) Foreign Application Priority Data

Nov. 9, 2021 (FR) ..... 2111865

(51) Int. Cl.
*B63H 9/08* (2006.01)
*B63H 9/061* (2020.01)
*B63H 9/10* (2006.01)

(52) U.S. Cl.
CPC ..... *B63H 9/08* (2013.01); *B63H 9/0621* (2020.02); *B63H 9/0628* (2020.02); (Continued)

(58) Field of Classification Search
CPC .... B63H 9/061; B63H 9/0621; B63H 9/0628; B63H 9/08; B63H 2009/086; B63H 9/10; B63H 9/1021; B63H 9/1042
See application file for complete search history.

(56) References Cited

U.S. PATENT DOCUMENTS 4,388,888 A * 6/1983 Gushurst, Jr. ..... B63H 9/061 114/102.32
5,445,098 A 8/1995 Marechal
(Continued)

FOREIGN PATENT DOCUMENTS

EP 0614803 A1 9/1994
FR 2702445 A1 * 9/1994 ..... B63H 9/1042
(Continued)

OTHER PUBLICATIONS

Search Report dated Jun. 22, 2022 from the Office Action for French Application No. 2111865 mailed Jun. 30, 2022, pp. 1-2. [See p. 1, categorizing the cited references].

*Primary Examiner* — Andrew Polay
(74) *Attorney, Agent, or Firm* — Lerner David LLP

(57) ABSTRACT

A vessel is provided with a mast, sail, and halyard for hoisting the sail. The sail includes dollies configured to be movable along the mast. The mast includes a guide member, the guide dollies configured to cooperate with said guide member, wherein:

the sail includes rigid panels, articulated two by two;

the mast is equipped with a transit part positioned at the end of the guide member, which has a flared lower portion and is open at its opposite ends, wherein during hoisting of the sail, each dolly is received in the transit part and is guided along to leave it through its upper opening and cooperate with the guide member, while during its lowering, each dolly is disengaged from the guide member, is received in the transit part, moves along it, and escapes from it by following the movement of the portion of the sail with which it is integral.

11 Claims, 13 Drawing Sheets

(52) U.S. Cl.
CPC .. *B63H 2009/082* (2013.01); *B63H 2009/086* (2013.01); *B63H 9/1021* (2013.01)

(56) References Cited

U.S. PATENT DOCUMENTS

| | | | | |
|---|---|---|---|---|
| 10,689,076 | B2 * | 6/2020 | Vautier | B63H 9/08 |
| 2011/0303140 | A1 * | 12/2011 | Cordier | B63H 9/0628 114/102.12 |
| 2019/0270498 | A1 | 9/2019 | Vautier et al. | |

FOREIGN PATENT DOCUMENTS

| | | | |
|---|---|---|---|
| WO | 2008136669 | A1 | 11/2008 |
| WO | 2018095860 | A1 | 5/2018 |

* cited by examiner

[Fig. 1]
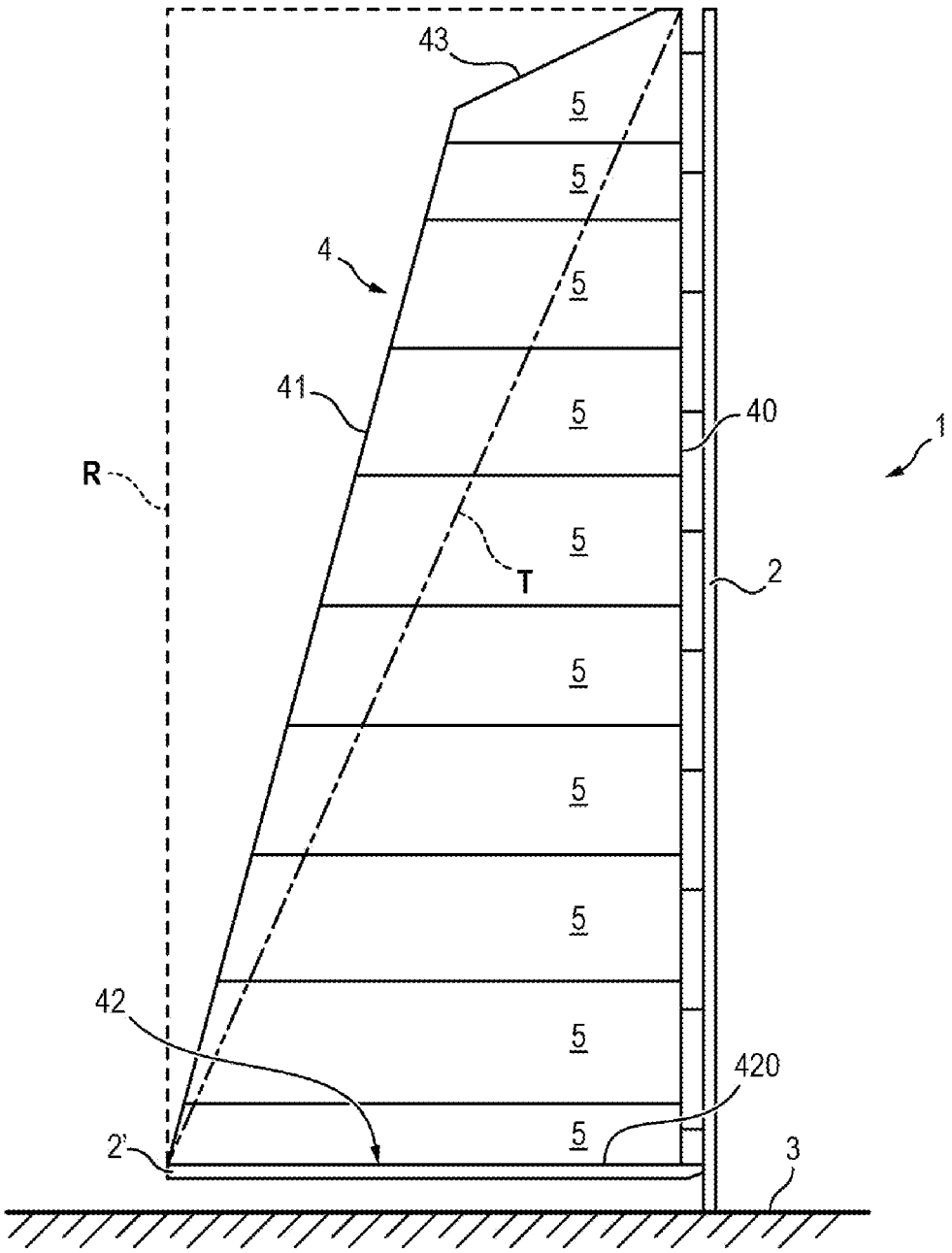

[Fig. 2]
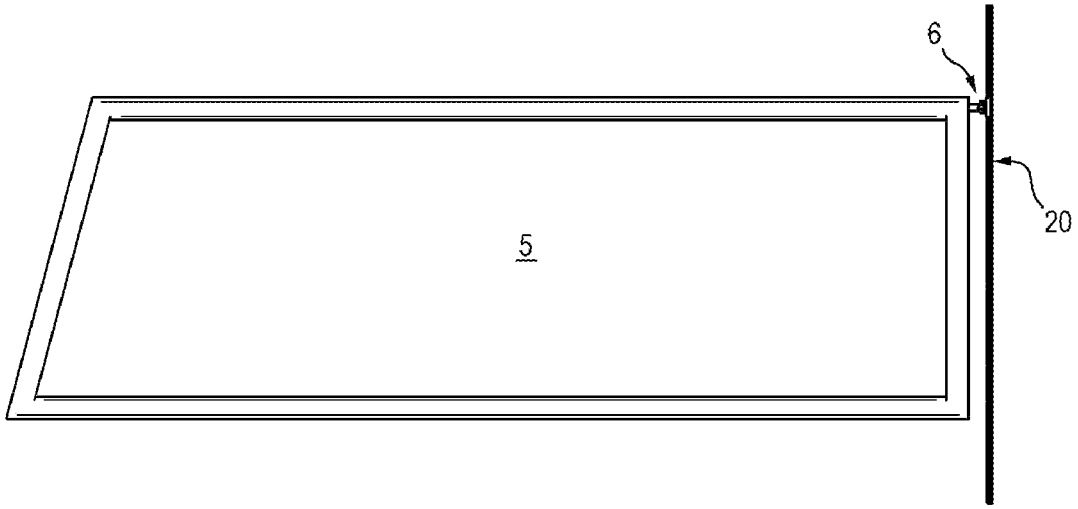
[Fig. 3]
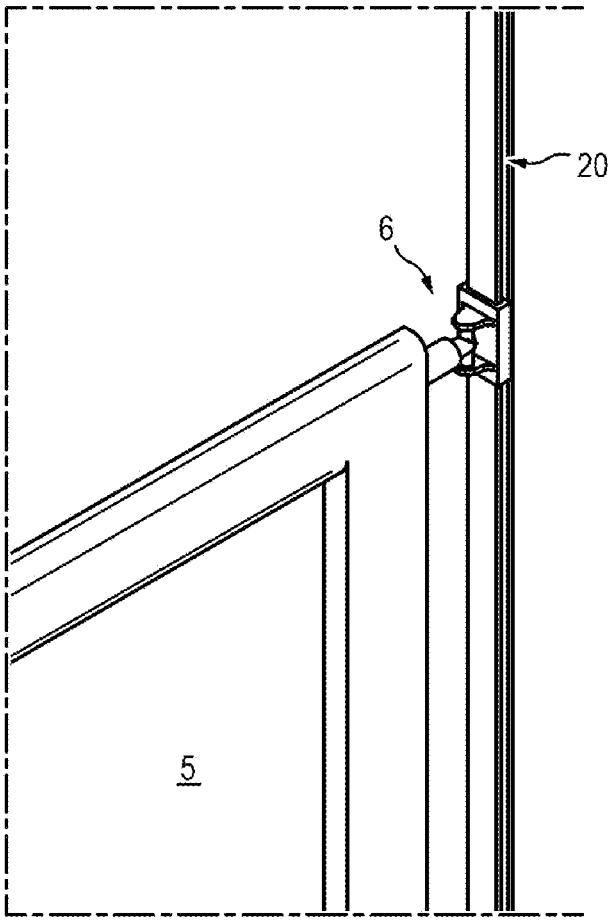

[Fig. 4]
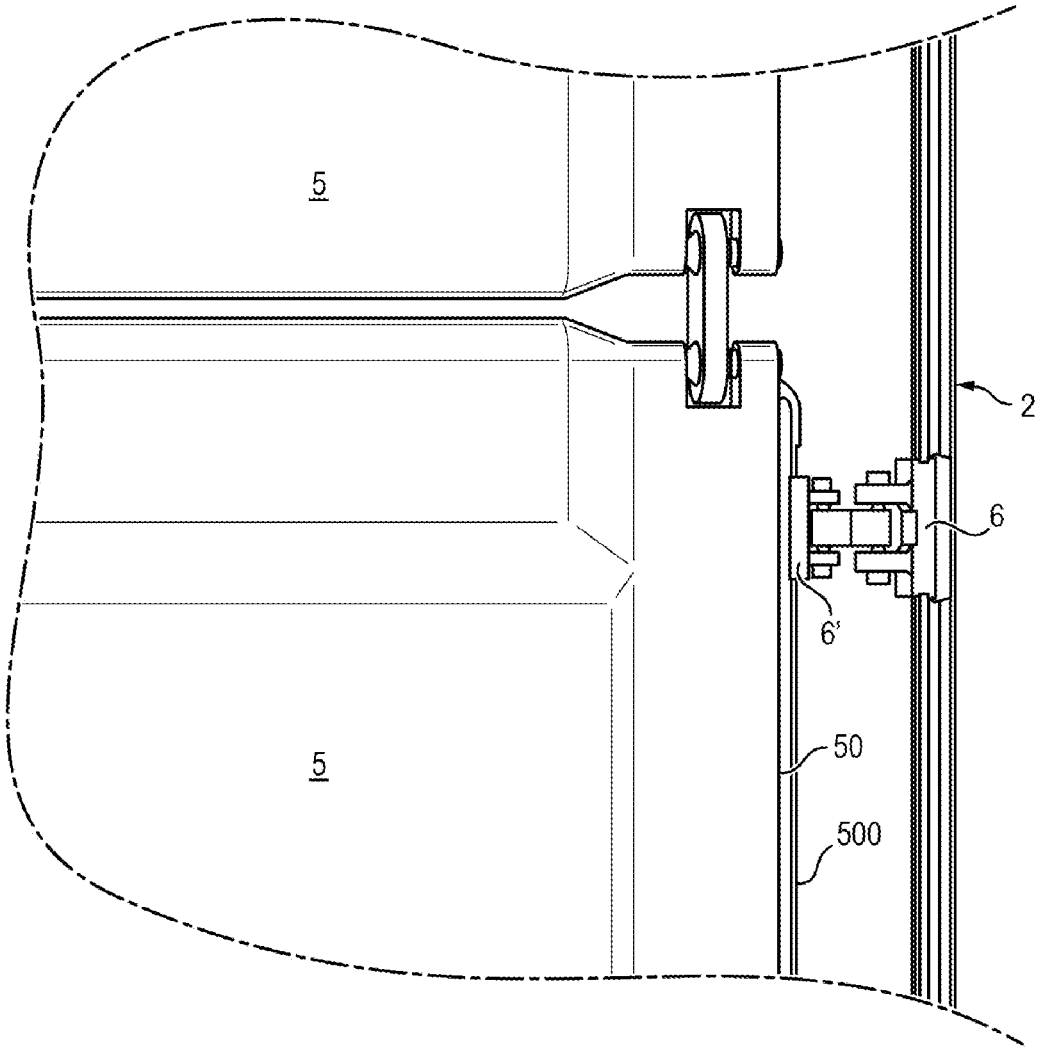

[Fig. 5]
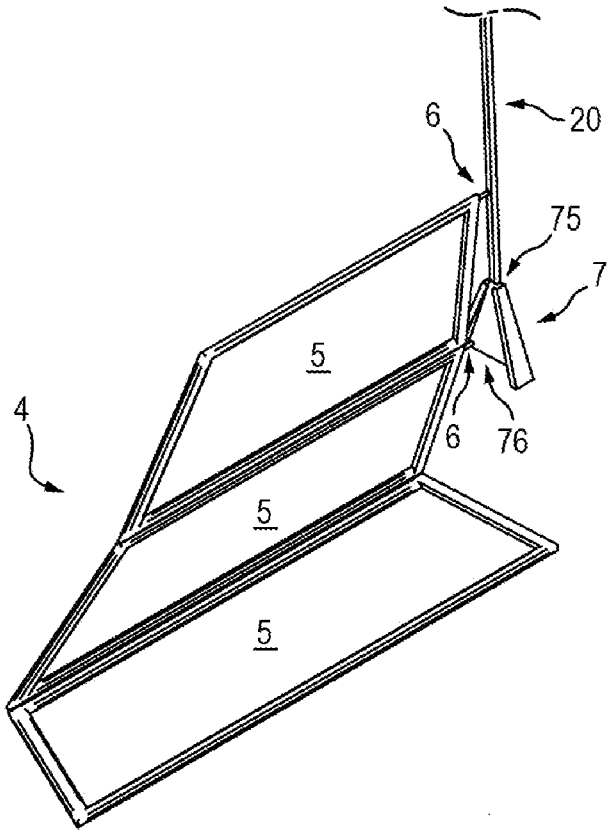

[Fig. 6]
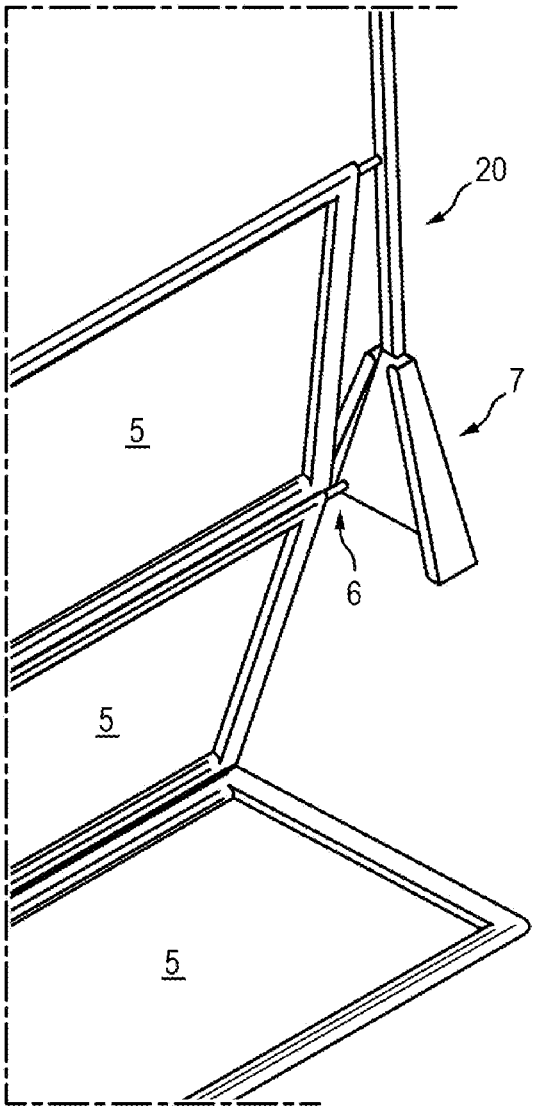

[Fig. 7]
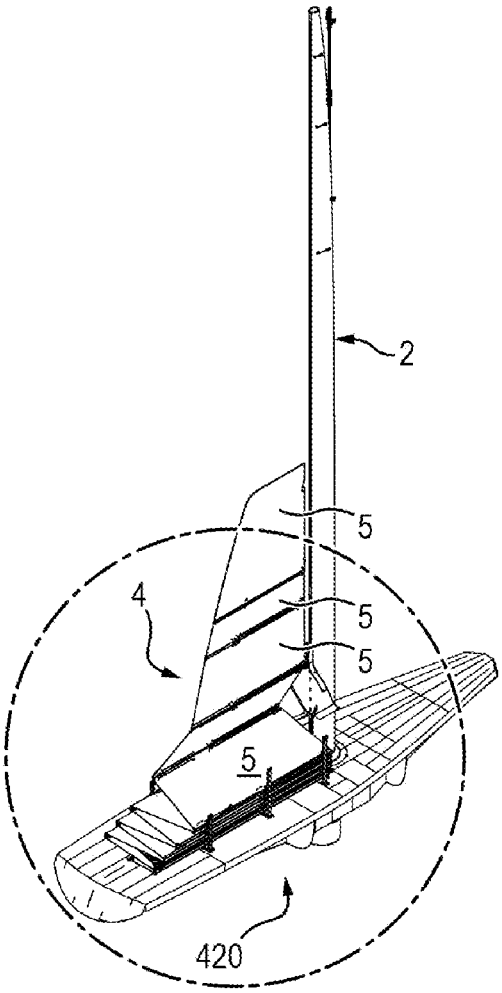

[Fig. 8]
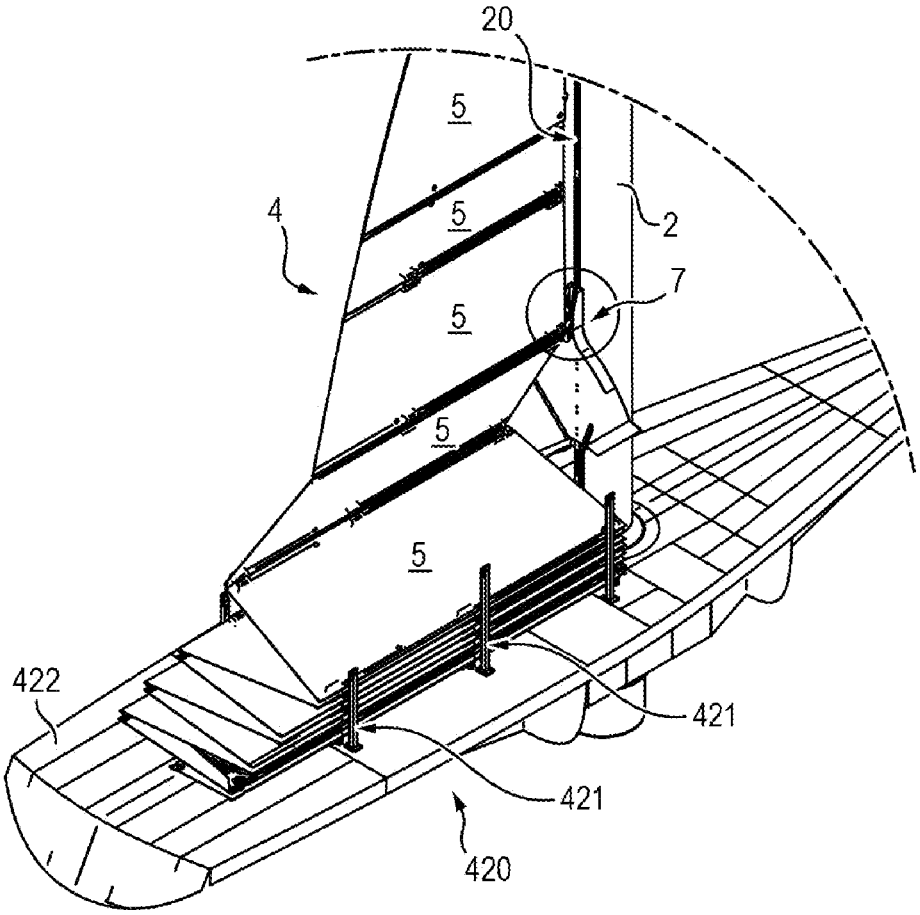
[Fig. 9]
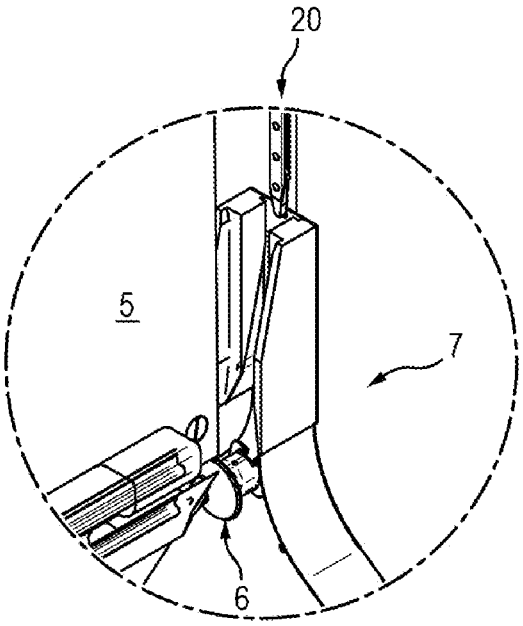

[Fig. 10]
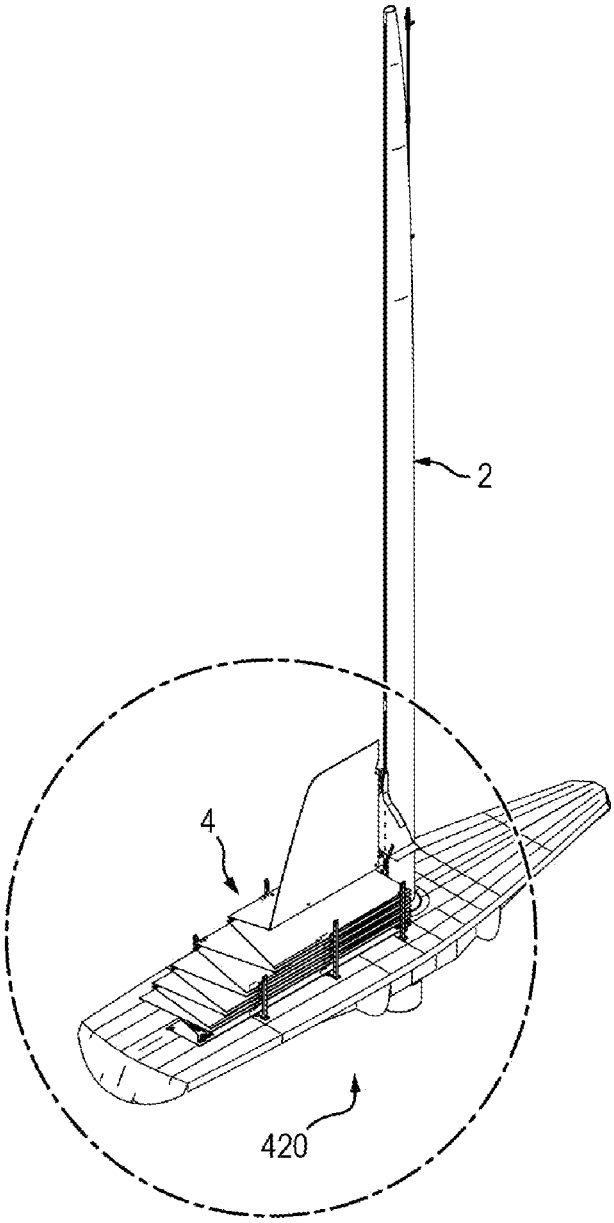

[Fig. 11]
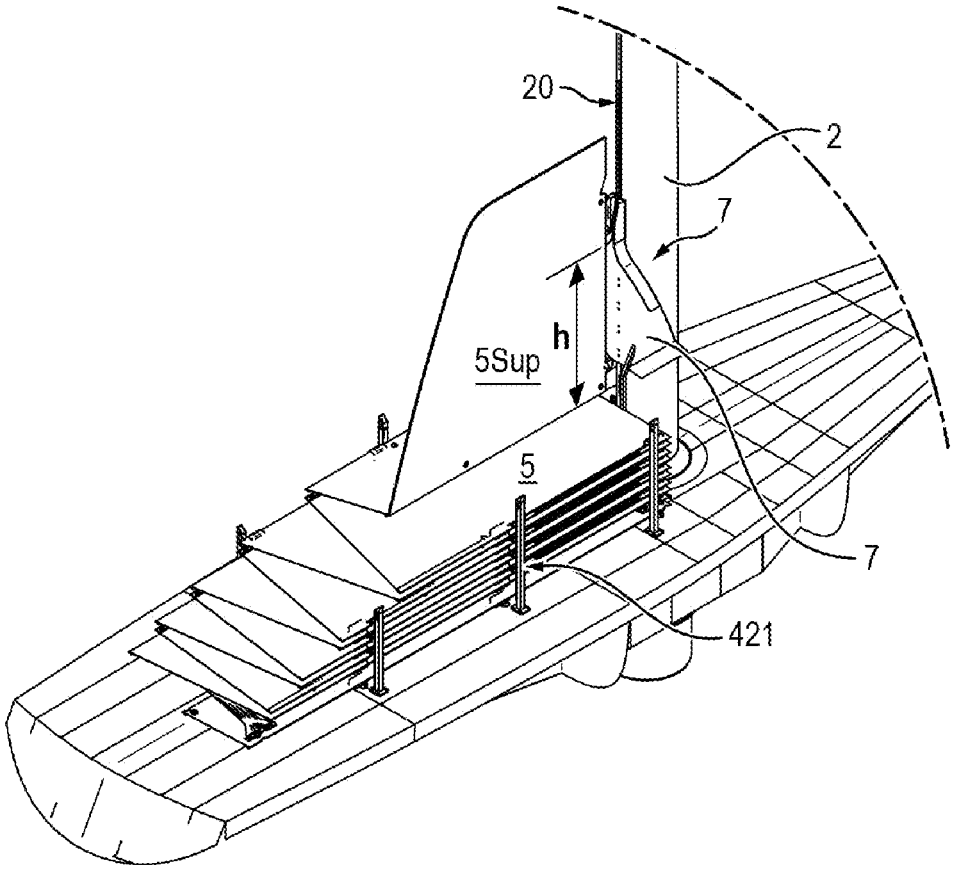

[Fig. 12]
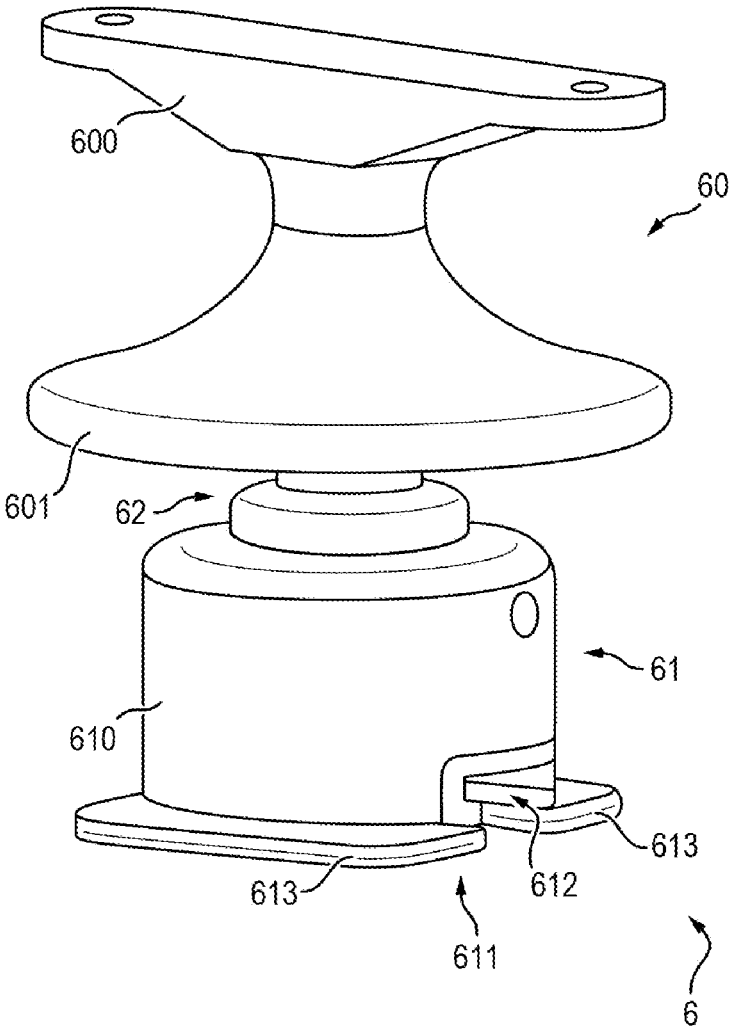

[Fig. 13]
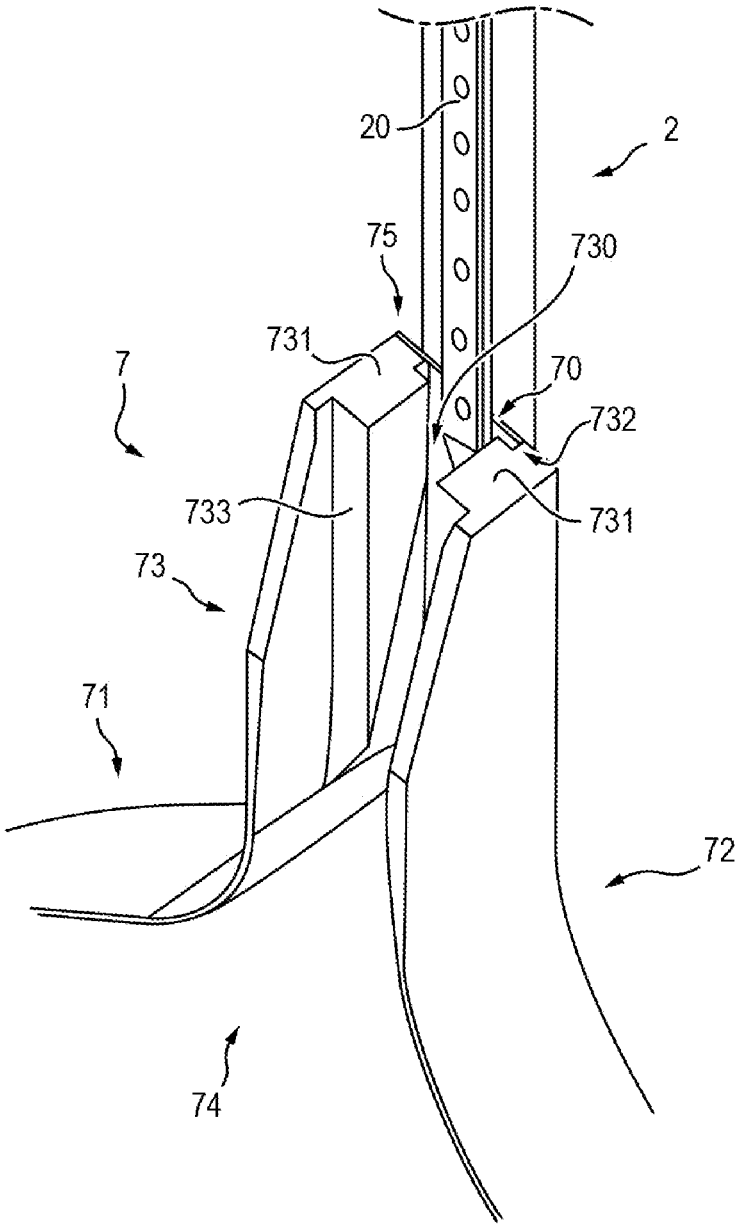

[Fig. 14]
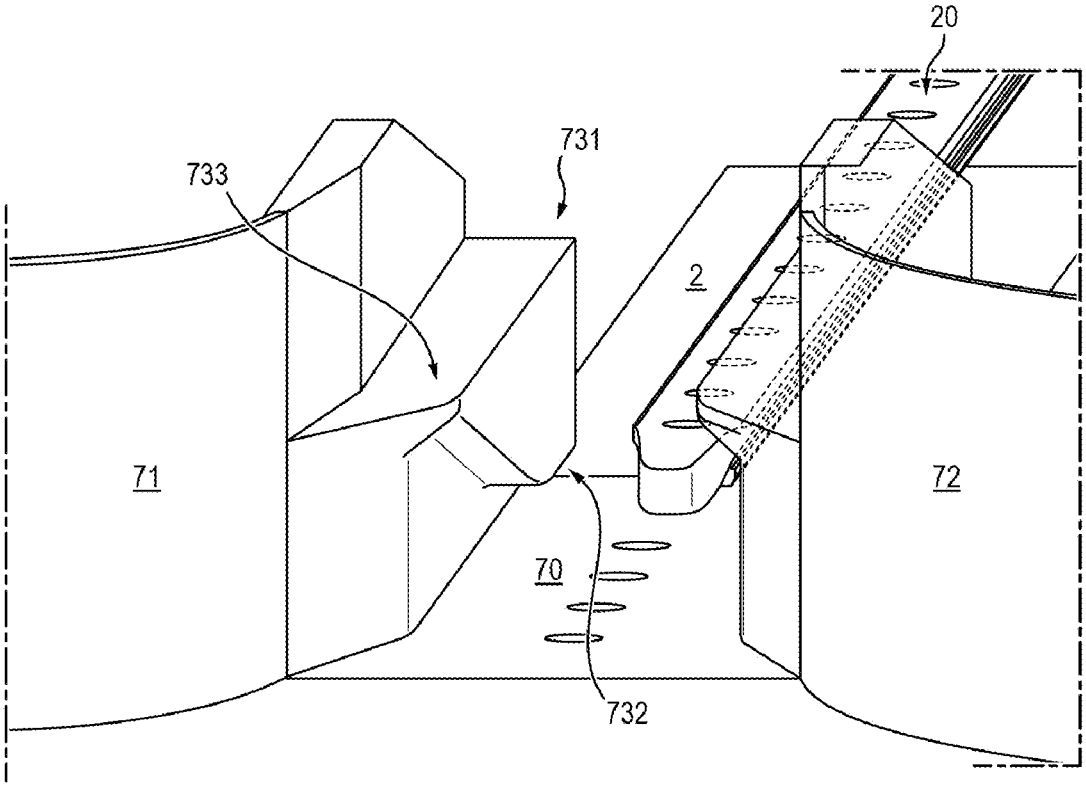

[Fig. 15]
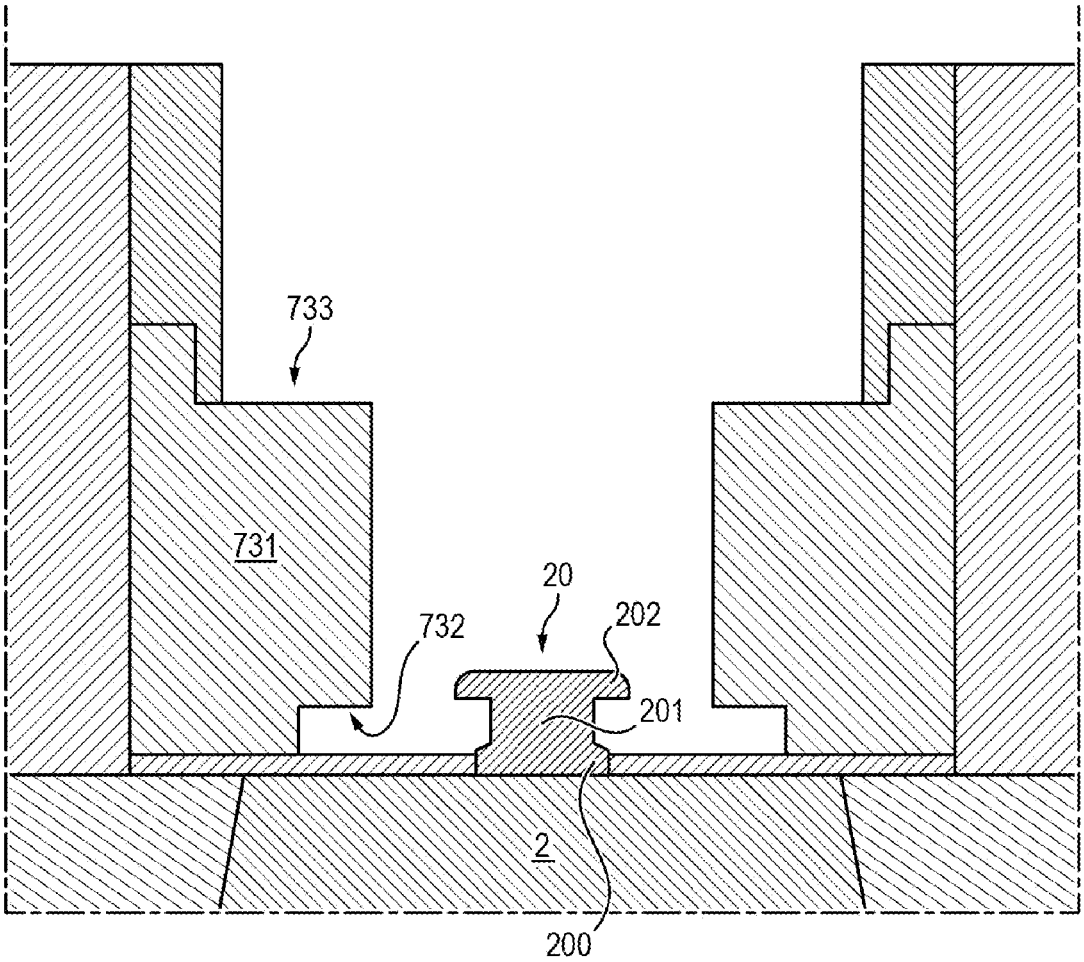
[Fig. 16]
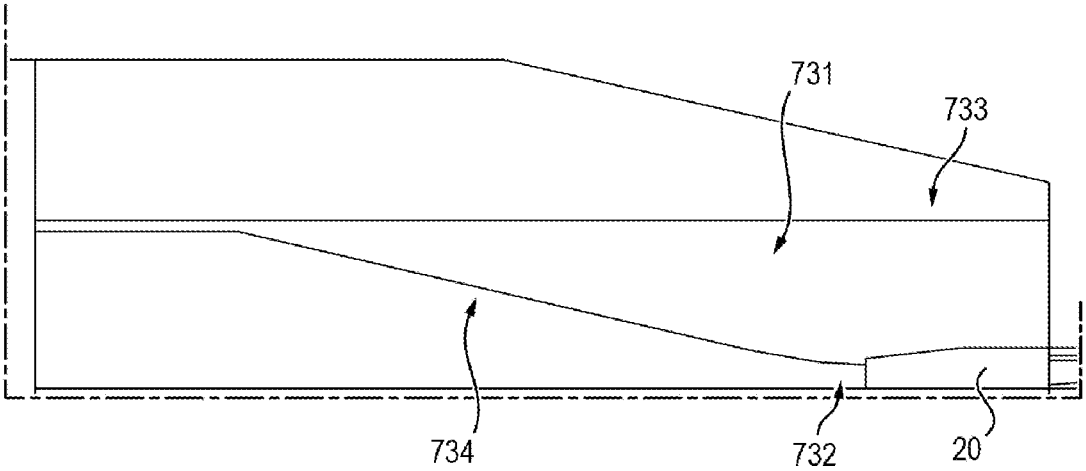

SAILING VESSEL PROVIDED WITH A TRANSIT PART FOR LOWERING AND HOISTING SAID SAIL

CROSS-REFERENCE TO RELATED APPLICATIONS

This application claims priority from French application number 2111865, filed Nov. 9, 2021, the disclosure of which is hereby incorporated herein by reference.

GENERAL TECHNICAL FIELD

The present invention is found in the general field of sailing vessels.

It applies more particularly to a vessel provided with a deck and a mast, which is equipped with a sail with a halyard for hoisting said sail, this sail including at least three sides, namely two longitudinal sides, constituting a "luff" and a "leech," as well as a lower transverse side or "foot," and this sail being provided, along said luff, with a plurality of dollies.

For its part, this mast is provided with a longitudinal guide member, said dollies being formed to cooperate with said member with the possibility of sliding during lowering and hoisting operations of said sail.

PRIOR ART

Known from the prior art are sails suited to the operation of a commercial or passenger transport vessel, i.e. a sail capable of being used intensively (even on vessels with a very large righting moment), regardless of the meteorological conditions encountered, while maximizing the return on investment of the rigging and of the sail.

Described thus for example in WO 2018/095860 is a sail 4 which is shown schematically in the appended FIG. 1.

It is shown in the hoisted position, in place on a mast 2 provided with a boom 420, which equips the deck 3 of a vessel 1.

The vessel 1 is not shown in detail. At all events, it can be a liner, a cargo transport vessel, a fishing boat, a pleasure sailboat, a yacht, etc.

In this illustrated embodiment, the sail has the shape of a quadrilateral which is inscribed in a right triangle. More precisely, this sail has two longitudinal sides 40 and 41 which are respectively denominated in professional terms "luff" and "leech," a lower transverse side denominated "foot" 42 attached to the boom 420, as well as an upper transverse side 43.

In the embodiment not shown, the sail can be inscribed in a rectangle like that defined by the dotted lines R, or in a right triangle like that delimited by the mixed lines T, these lines being visible in the aforementioned figure.

This sail consists of a set of panels 5.

In FIG. 1, ten panels 5 are present, but this number could be different, i.e. smaller or larger.

In the lowered position of the sail, the different panels 5 which constitute it are alternative superposed on one another at the lower portion of the mast, in a "zigzag" or "accordion" arrangement. Thus, the sail is folded over itself in a manner of speaking.

Shown in FIG. 2, is a single panel 5 of the sail in conformity with the aforementioned prior art. However, what follows applies to the other panels of the sail. This panel is integral with a member forming a dolly 6, which is arranged to slide along a guide rail 20 which extends vertically along one surface of the mast 2. FIG. 3 allows better understanding of this configuration.

In one particular embodiment and as illustrated in FIG. 4, to allow hoisting the sail or bringing it back into the lowered position, each panel 5 is provided along its longitudinal edge 50 closest to the luff 40 with a guide rail 500 in which is arrange a sliding dolly 6' called a "panel dolly", this dolly 6' being formed to move freely along the rail while still having a movement limited by the opposite ends of this rail 500. This rail extends for example only over a portion of the edge 50.

Due to these means, the hoisting and lowering maneuvers of the sail, which make use of a halyard, are facilitated.

However, the fact that each dolly 6 of each panel 5 remains integral with the guide rail 20 during the entire maneuver, including when completely lowered, imposes kinematic constraints. Moreover, considerable friction is noted, which generates risks of blocking during the maneuvers of the sail. Likewise, the fact that each panel is provided with a guide rail increases significantly the cost of manufacture of these panels.

PRESENTATION OF THE INVENTION

The present invention has as its object solving the technical problems stated above.

In other words, it seeks to propose a sailing vessel, in which hoisting and lowering maneuvers, although carried out with guide dollies, are easy to perform, while drastically reducing friction, this through the use of simple technical means.

Thus, the present invention relates to a vessel provided with a deck, with a mast and with a boom or with a sprit, said mast being equipped with a sail with a halyard for hoisting said sail, said sail including at least three sides, namely two longitudinal sides, constituting a "luff" and a "leech," as well as a lower transverse side or "foot," this said being provided, along said luff, with a plurality of protruding dollies formed to be able to be moved along said mast;

said mast being provided longitudinally with a guide member, said guide dollies being formed to cooperate with said guide member with the possibility of siding during lowering and hoisting operations of said sail, characterized in that:

said sail consists of rigid panels, articulated two by two;

said mast is equipped with a transit part positioned at the lower end of said guide member, this transit part having a flared lower portion in the direction of the base of said mast and being open at its upper and lower ends, so that during the hoisting of said sail with said halyard, each dolly of said sail is automatically received in said transit part by its lower opening and is progressively guided along it to leave it through its upper opening and cooperate with said guide member, while during its lowering, each dolly is automatically and progressively disengaged from said guide member, is received in the transit part, moves along it, then escapes from it by its lower opening by following the movement of the portion of the said with which it is integral.

Due to these characteristics, both during folding (lowering) and during unfolding (hoisting) of the sail, only a portion of the aforementioned dollies cooperates with the guide member, while the others are not integral with it, which considerably reduces the friction noted in the prior art.

Moreover, the "departure" and "entry" movements of the dollies are easily carried out due to the transit part, with no risk that one of the dollies is badly positioned at departure or at entry to the mast.

In addition, this transition part allows dispensing with the panel rail described above, thus reducing the cost of manufacture of the sail.

According to other advantageous and non-limiting features of the invention, taken individually or in a technical compatible combination of at least two of them:

- said guide member consists of a rail which protrudes at least partially from the surface of said mast, or of a channel which runs along said mast;
- it includes, on said boom or said sprit, means for retaining and containing said sail in the lowered position, which consist of a gutter, a cradle, or a set of side walls;
- each panel is provided with a dolly, the mutual spacing between two dollies being constant;
- said transit part includes an non-flared upper portion which is located in the continuation of said flared lower portion and the distance h that separates the junction zone of these two portions of the peak of the sail stack in the lowered position is greater than 0.5 times the distance that separates two adjacent dollies of the sail in the hoisted position;
- each dolly includes a first portion integral with said sail, as well as a second portion formed to cooperate with said guide member in the hoisted position of said sail, these two portions being connected by a ball joint or by a connection pivoting around at least two rotation axes;
- said first portion includes a disc-shaped element, while said second portion includes a massive body, the base of which has a vertically-oriented groove, this groove having a profile complementary to that of the guide member, as well as two symmetrical fins;
- the upper opening of said transit part opens on a channel the facing edges of which have the shape of symmetrical profiled sections, the spacing of which is equal, within the clearance, to the width of the massive body of said dolly, profiled sections which have a cutaway at their base, the shape of which is complementary to that of the fins of said massive body;
- the lower opening of said transit part has a width greater than a sixth of the distance between two dollies when the sail is hoisted.
- the lowest point of said transit part is distant from said boom or from said sprit by a distance greater than the thickness of said sail in the completely lowered position.

DESCRIPTION OF THE FIGURES

Other features and advantages of the invention will appear in the description that will now be given, with reference to the appended drawings which represent, by way of indication but without limitation, one possible embodiment of it.

In these drawings:

FIG. 1 is, as already specified, a very schematic front view of a sail formed from articulated panels as described in more detail in WO 2018/095860;

FIG. 2 is a front view of only one of these panels, in which is also visible a guide dolly that equips it;

FIG. 3 is an enlarged perspective view of the portion of the panel provided with said dolly, as well as of the guide rail with which it cooperates;

FIG. 4 is a partial front view of two panels equipped with a pair of guide dollies;

FIG. 5 is a very simplified schematic of a portion of the sail and of a transit part placed in the lower portion of the mast of the vessel, this schematic being intended to illustrate the principle on which the invention is based;

FIG. 6 is an enlarged view of the right portion of FIG. 5;

FIG. 7 is a perspective view of the mast, of the sail and of the sprit of a vessel conforming to the present invention;

FIG. 8 is an enlarged view of the portion marked with a circle in FIG. 7;

FIG. 9 is an enlarged view of the portion marked with a circle in FIG. 8, showing more specifically the transit part of the sail;

FIG. 10 is a view substantially similar to FIG. 7, except that the sail is shown in the lowered position;

FIG. 11 is an enlarged view of the portion marked with a circle in FIG. 10;

FIG. 12 is a perspective view of a dolly which equips the sail;

FIG. 13 is a view similar to FIG. 9, but enlarged, neither the dolly nor a panel being shown there;

FIG. 14 is a first detail view of said transit part;

FIG. 15 is a second detail view of said transit part;

FIG. 16 is a third detail view of said transit part.

DETAILED DESCRIPTION OF THE INVENTION

The description that follows is given in connection with a vessel 1 the sail 4 of which consists of articulated panels 5, as described for example in the aforementioned international application. This application can be referred to for more detail on the articulation means located between two adjacent panels.

It is possible to refer to the appended FIGS. 5 and 6 to explain the principle on which the present invention is based.

In these figures, only three panels 5 of the sail 4, which is in the process of being folded, i.e. lowered, are shown. The lower panel 5 is positioned flat on a boom or a sprit, not shown, while the two other panels undergo a descending movement along the mast, in order to be folded in their turn on the aforementioned lower panel 5.

Solely for the sake of simplification, the mast of the vessel has not been shown, and only the vertically-oriented guide rail 20 which equips it can be distinguished.

In this example, the rail 20 is protruding above a surface of the mast. In another configuration, this rail could be positioned in a groove running all along the mast. In yet another configuration, only a simple channel which extends all along the mast, instead of an actual rail, could be involved.

At all events, these different embodiments constitute a guide member for the guide dolly 6 which equips each of the panels 5.

In these FIGS. 5 and 6, the guide dolly 6 has been shown only in the symbolic shape of a rod, this simply for the purpose of illustration. Each panel 5 is provided with a guide dolly of this type along its vertical edge which constitutes, with the other panels, the luff 40 of the sail 4.

Preferably, the dollies are equidistant from one another.

As can be seen in these figures, a transit part 7 is located at the lower end of the rail 20, which has the overall shape of an inverted funnel. There too, this is a purely symbolic representation given solely for the purpose of explanation. A particular form of this transit part will be described below.

The principle on which the invention is based resides in the fact that if it is desired to lower the sail 4, each of the dollies 6 associated with a panel 5 of the sail will be caused to slide along the rail 20 until it is positioned at the open upper entry of the transit part 7.

The dolly 6 then finally leaves the rail 20 and is engaged in the transit part 7, to leave it by its open lower end.

The associated panel 5, thus freed but still held by the halyard, can thus position itself on the preceding panel 5 which is already lowered.

Conversely, i.e. when proceeding with the hoisting of the sail 4 by means of a halyard, not shown, the panels 5 are in turn moved from the bottom upward in the direction of the lower opening of the transit part 7 and their dolly is moved little by little toward its converging upper end, then transferred to the rail 20 with which it is caused to cooperate.

A particular mode of solution of the invention is now described with reference to the appended FIGS. 7 to 16.

In FIGS. 7 and 8, the sail 4 of the vessel is shown in a partially lowered position. Thus, the lowest panels 5 of the sail are already folded over one another and stored on the upper surface 422 of the sprit 42.

In order to retain these panels 5 on the sprit 42, over time, all the panels of the sail when it is completely lowered, the upper surface 422 includes means of confinement which consists here of a set of side walls 421 which are distributed by pairs with a mutual spacing compatible with the dimensions of the panels 5.

In other embodiments, not shown, this could be a cradle, a gutter or any other similar means of confinement.

In FIG. 9, a possible embodiment of the dolly 6 is distinguished more precisely, as well as the upper portion of an embodiment of the transit part 7.

FIGS. 10 and 11 are similar to FIGS. 7 and 8, except that all the panels 5 of the sail are lowered, with the exception of the upper panel labeled 5 Sup. Under these conditions, this upper panel remains in the vertical position, with its dolly 6 cooperating with the rail 20 of the mast 2.

In FIG. 12 is shown a possible embodiment of the dolly 6.

This dolly includes a first portion 60 integral with the associated panel 5, as well as a second portion 61 intended to cooperate with the rail 20 of the mast 2 in the hoisted position of the sail 4.

These two portions are connected by a ball joint 62 which allows a great freedom of movement with respect to one another.

More precisely, the first portion 60 includes a baseplate 602 for attachment to a panel 5, which is attached in the direction of the ball joint 62 to a disc-shaped element 601. The function of this element 601 will be explained later in the description.

The second portion 61 includes a massive body 610, the base 611 of which, which is opposite the ball joint 62, has a vertically-oriented groove 612, this groove having a profile complementary to that of the rail 20, which will be described later in the description.

The aforementioned ball joint can advantageously be replaced by a connection pivoting around at least two rotation axes.

Finally, two symmetrical fins 613 extend on either side of the base 611. These fins 613 have the same orientation as the groove 612 and protrude from the massive body 610.

The particular shape of the rail 20 is visible in particular in FIG. 15. This comprises a base 200, from which extends vertically a base 201 which is topped by a transverse bar 202, which confers upon this rail a "T" shaped profile. The aforementioned groove 612 which the dolly 6 includes is therefore formed to cooperate with this rail, by sliding along it.

As can be seen in particular in FIG. 13, the transit part 7 essentially includes a bottom 70 and two symmetrical fins 71 and 72 diverging downward. It includes a non-flared upper portion (with parallel edges) 73 as well as a flared lower portion 74. Its upper opening is labeled 75, while its lower opening is labeled 76.

This part 7 is attached to the mast 2 by its bottom 70 in such a manner that the lower end of the rail 20 is partially engaged in the upper opening 75.

The opening 75 opens on a channel 730 the facing edges of which have the shape of symmetrical profiled sections 731. Their spacing is equal, within the clearance, to the width of the body 610 of the dolly 6. They have a cutout 732 at their base, the shape of which is complementary to that of the fins 613 of the body 610.

In this manner, when the dolly 6 is moved in the direction of descent, it is partially engaged in the cutouts 732 by the fins 613 when it has not yet completely left the rail 20.

The aforementioned profiled sections 731 have a height such that each provides an upper face 733 forming a slide. This height is selected in such a manner that when the dolly 6 is in the position indicated above, the disc-shaped element 601 extends above and preferably at a distance from these upper faces 733.

Thus it is possible to carry out a gentle transition from the dolly 9 of the rail 6 to the transit part 7 and conversely.

The profiled sections 731 are progressively interrupted to die off at the entry of the flared lower portion. Moreover, and as shown in FIG. 16, the cutouts 732 continue in the direction of the flared portion with an opening 733 with a rising slope which is interrupted at the same time as the end of the profiled sections 731.

Thus, progressively with the movement of the dolly 6 along the non-flared upper portion of the part 7, the panel has a latitude of movement which it had not had before. It can then be freely folded onto the other panels which are already lowered.

During the reverse movement, namely during hoisting of the sail 4, the movement of the halyard causes the progressive elevation of each of the panels 5.

In doing so, the dolly 6 of a panel comes to be positioned at the lower open end of the transit part 7. The fins 71 and 72 form converging confining means which guide the dolly 6 in the direction of the non-flared upper portion 73. It should be noted that in the embodiment described here, the fins 71 and 72 have a curved shape. They could, however, have a straight shape.

The disc-shaped element 601 slides or rolls along one of the fins 71 or 72 to bring the dolly 6 to the entry of the channel 730, then the body 610 is then engaged in this channel 730. The disc-shaped element 601 of the dolly 6 extends above and preferably at a distance from the upper faces 733 while the element 613 of the dolly 6 slides along the surface 734 of the profiled sections 731 so that the dolly 6 can be partially engaged in the cutouts 732 by the fins 613.

Upon continuing this movement, the dolly 6 arrives progressively at the entry of the rail 20 and the transition to it occurs gently through cooperation of the groove 612 with this rail.

Thus the friction observed with the technical means of the prior art is very significantly limited. Moreover, the fact that the panels are no longer integral with the rail in the lowered position facilitates maneuvers.

Advantageously, the lowest point of the transit part 7 is distant from the sprit 42 by a distance greater than the thickness of said sail 4 in the completely lowered position. However, this point can be placed higher or lower, on condition that at least one dolly 6 remains engaged in the transit part or the guide rail, without upsetting the operation of the assembly.

Also advantageously, and for optimal operation, the opening of the lower portion 76 of the transit part 7 has a width greater than a sixth of the distance between two dollies 6 when the sail 4 is hoisted.

Still advantageously and as shown in FIG. 11, the distance h which separates the junction zone of these two non-flared upper 73 and flared lower 74 portions from the peak of the sail 4 stack in the lowered position is greater than 0.5 times the distance which separates the two adjacent dollies 6 of the sail 4 in the hoisted position. This contributes to better positioning of the sail 4 with respect to the transit part 7, for the purpose of hoisting it.

Throughout the present application, what has been described with reference to a sprit applies equally to a boom, and conversely.

The invention claimed is:

1. A vessel provided with a deck, with a mast and with a boom or with a sprit, said mast being equipped with a sail with a halyard for hoisting said sail, said sail including at least three sides, namely two longitudinal sides, constituting a luff and a leech, as well as a lower transverse side or foot, this sail being provided, along said luff, with a plurality of protruding dollies formed to be able to be moved along said mast;

said mast being provided longitudinally with a guide member, said dollies being formed to cooperate with said guide member with the possibility of sliding during lowering and hoisting operations of said sail, wherein:

said sail consists of rigid panels, articulated two by two;

said mast is equipped with a transit part positioned at the lower end of said guide member, this transit part having a flared lower portion in the direction of the base of said mast and being open at its upper and lower ends, so that during the hoisting of said sail with said halyard, each of said dollies of said sail is automatically received in said transit part by its lower open end and is progressively guided along it to leave it through its upper opening and cooperate with said guide member, while during its lowering, each dolly is automatically and progressively disengaged from said guide member, is received in said transit part, moves along it, then escapes from it by its lower open end by following the movement of the portion of the sail with which it is integral.

2. The vessel according to claim 1, wherein said guide member consists of a rail which protrudes at least partially from the surface of said mast, or of a channel which runs along said mast.

3. The vessel according to claim 1, wherein it includes, on said boom or said sprit, means for retaining and containing said sail in a lowered position, which consist of a gutter, a cradle, or a set of side walls.

4. The vessel according to claim 1, wherein each panel is provided with a dolly, the mutual spacing between two dollies being constant.

5. The vessel according to claim 4, wherein said transit part includes a non-flared upper portion which is located in the continuation of said flared lower portion and that the distance h which separates the junction zone of these two upper and lower portions from the peak of said sail stack in the lowered position is greater than 0.5 times the mutual spacing between two adjacent dollies of said sail in said hoisted position.

6. The vessel according to claim 1, wherein each of said dollies includes a first portion integral with said sail, as well as a second portion formed to cooperate with said guide member in said hoisted position of said sail, these first and second portions being connected by a ball joint or by a connection pivoting around at least two rotation axes.

7. The vessel according to claim 6, wherein said first portion includes a disc-shaped element, while said second portion includes a massive body, the base of which has a vertically-oriented groove, said vertically oriented groove having a profile complementary to that of said guide member, as well as two symmetrical fins.

8. The vessel according to claim 7, wherein the upper open end of said transit party opens on a channel the facing edges of which have the shape of symmetrical profiled sections the spacing of which is equal, within the clearance, to the width of said massive body of said dolly, said profiled sections having a cutaway at their base, the shape of which is complementary to that of said symetrical fins of said massive body.

9. The vessel according to claim 4, wherein the lower open end of said transit part has a width greater than a sixth of the mutual spacing between two dollies when the sail is hoist.

10. The vessel according to claim 1, wherein the lowest point of said transit part is distant from said boom or from said sprit by a distance greater than the thickness of said sail in a completely lowered position.

11. The vessel according to claim 2, wherein the vessel includes, on said boom or said sprit, means for retaining and containing said sail in a lowered position, which consist of a gutter, a cradle, or a set of side walls.

* * * * *